US006212709B1

(12) United States Patent
Newton

(10) Patent No.: US 6,212,709 B1
(45) Date of Patent: Apr. 10, 2001

(54) SHOWER DRAIN TOOL AND METHOD FOR INSTALLING AND REMOVING A SHOWER DRAIN

(76) Inventor: Donald A. Newton, 2221 Bluebell Dr. Unit C, Santa Rosa, CA (US) 95403

( * ) Notice: Subject to any disclaimer, the term of this patent is extended or adjusted under 35 U.S.C. 154(b) by 0 days.

(21) Appl. No.: 09/251,204

(22) Filed: Feb. 16, 1999

(51) Int. Cl.[7] ..... A47K 3/40
(52) U.S. Cl. ..... 4/661; 4/613; 81/436
(58) Field of Search ..... 4/286, 613, 661; 81/176.15, 176.2, 436, 437, 451

(56) References Cited

U.S. PATENT DOCUMENTS

| | | | | |
|---|---|---|---|---|
| 494,579 | | 4/1893 | Lunken . | |
| 2,515,558 | | 7/1950 | Kluth | 81/71 |
| 2,605,664 | * | 8/1952 | Galbraith | 81/176.15 |
| 2,803,981 | | 8/1957 | Stoecker | 81/90 |
| 2,859,452 | * | 11/1958 | Seewack | 4/613 X |
| 2,956,461 | * | 10/1960 | Anderson | 81/176.15 |
| 4,237,755 | * | 12/1980 | Gunnell, III | 81/176.15 |
| 4,982,629 | | 1/1991 | Germain | 81/176.1 |
| 5,090,276 | * | 2/1992 | Groskey | 81/436 |
| 5,214,985 | | 6/1993 | Rinehart | 81/176.15 |
| 5,685,209 | | 11/1997 | Fiedler | 81/436 |
| 5,946,990 | * | 9/1999 | Bonacci | 81/176.15 |

* cited by examiner

*Primary Examiner*—Robert M. Fetsuga
(74) *Attorney, Agent, or Firm*—Russo & Hale LLP; William C. Milks, III

(57) ABSTRACT

A shower drain tool includes a blade for engagement with the ribs on the internal surface of a shower drain. The tool also includes a stabilizer plate connected to the blade to seat the tool on the drain and prevent the tool from falling through the drain into the drain pipe. The tool further includes one of various tool adapters. The tool adapter can be a nut to be spanned by an adjustable or open-end wrench, or a hole into which a socket wrench drive or the tip of a breaker bar or T bar can be inserted, to rotate the tool. The tool adapter can also be a pipe wrench extension so that a pipe wrench can be used to rotate the tool. Alternatively, the tool can include a device, such as a T bar, integral with the stabilizer plate to rotate the tool.

17 Claims, 4 Drawing Sheets

SHOWER DRAIN TOOL AND METHOD FOR INSTALLING AND REMOVING A SHOWER DRAIN

BACKGROUND OF THE INVENTION

The present invention relates to tools and, more particularly, to tools for use by plumbers or ceramic tile contractors for installing and removing drains. Specifically, one embodiment of the present invention provides a tool to facilitate installation and removal of a shower drain typically employed in a shower having a tile floor.

Many tools have been developed for use by the construction industry. Various general purpose tools are commonplace, such as a hammer, saw, screwdriver, wrench, and numerous other tools. Certain tools have been developed or refined for particular trades, for example, roofing hammers have been developed for roofers, miter saws have been developed for finish carpenters, side cutters have been developed for electricians, and pipe wrenches have been developed for plumbers, etc. Specialized tools facilitate efficient completion of the work required to be performed by the particular tradesman.

By way of example, plumbers typically possess various tools, such as a pipe wrench, pipe cutter, breaker bar, T bar, etc. Plumbers also typically use specialized tools that enable them to more efficiently complete certain tasks, such as the installation of drain hardware.

For example, U.S. Pat. No. 5,090,276 discloses a wrench for installing a strainer base (30) in a sink. The wrench includes a drive bar (16) attached to a depth limiting device (20). The depth limiting device (20) ". . .is dimensioned so as to permit it to enter the upper part of the throat (36), but to come to rest in a mid portion of the throat." See column 6, lines 1–4 of U.S. Pat. No. 5,090,276. The drive bar (16) is configured to engage notches (40) in the strainer base (30). Consequently, the drive bar (16) is dimensioned to fit entirely through the throat (36) of the sink base and to reside in a position in which each end of the drive bar (16) engages one of the opposed notches (40). Therefore, the strainer base installation tool disclosed in U.S. Pat. No. 5,090,276 is specialized for installation of an internally tapered strainer base having notches.

There are other types of drains, for example, shower drains, which are difficult to install and remove. One known type of shower drain is a type employed for drains in showers having tile floors and is commonly known as an E-Z Test drain. An E-Z Test drain, generally indicated by the numeral 1, is shown in FIG. 1. The E-Z Test drain 1 has an internally threaded flange 2 which is rotated onto an externally threaded drain pipe 3. The flange 2 has a lip 4. The E-Z Test drain 1 also has a rim 5. A waterproof shower pan membrane 6 is captured between the flange 2 and the rim 5, and the rim is mounted to the flange by bolts 7. The rim 5 also has internal ribs 8 having threaded holes 9 for mounting a strainer screen (not shown) to the E-Z Test drain 1.

Conventionally, in order to install the E-Z Test drain 1, a plumber or ceramic tile contractor uses a pipe wrench. He or she places the pipe wrench over the lip 4 of the flange 2 of the E-Z Test drain 1 and applies torque to tighten the flange onto the drain pipe 3. Then, the rim 5 is bolted onto the flange 2 to capture the shower pan membrane 6 between the flange and the rim. The plumber or ceramic tile contractor reverses the procedure to remove the E-Z Test drain 1. Removal is often difficult, since the bolts 7 are embedded in grout and the flange 2 is often fused by corrosion to the drain pipe 3. If the plumber or ceramic tile contractor simply grasps the rim 5 between the jaws of a pipe wrench and applies torque, the rim can break without effecting removal of the E-Z Test drain 1.

Consequently, it would be desirable to provide a tool for removal of a commonplace shower drain used in a shower having a tile floor, such as the E-Z Test drain. It would also be desirable to provide a tool to facilitate installation of such a drain. Preferably, such a tool would be rugged in construction and inexpensive and yet provide an effective tool for removal and installation of a shower drain.

SUMMARY OF THE INVENTION

One embodiment of the present invention provides a tool to remove a shower drain commonly used as a drain for a shower having a tile floor. The shower drain tool in accordance with the present invention can also facilitate installation of the drain.

The shower drain tool in accordance with an embodiment of the present invention comprises a blade for engagement with the ribs of a shower drain so that the drain can be rotated by torque applied to the blade. The shower drain tool also comprises a stabilizer plate connected to the blade to seat the tool on the shower drain and prevent the tool from falling through the drain into the drain pipe. Additionally, the shower drain tool preferably comprises means coupled to the stabilizer plate for imparting rotation to the blade.

In one embodiment, the means coupled to the stabilizer plate for imparting rotation to the blade of the shower drain tool comprises a tool adapter comprising an approximately square nut to be spanned by an adjustable wrench or open-end wrench and rotated to apply torque via the blade to the shower drain to remove or install the drain. In an alternative embodiment, the tool adapter of the shower drain tool comprises an approximately square hole into which a socket wrench drive or the tip of a breaker bar or T bar can be inserted to rotate the tool. The tool adapter can also have a pipe wrench extension so that a pipe wrench can be used to rotate the tool. In a modified embodiment, the means coupled to the stabilizer plate for imparting rotation to the blade of the shower drain tool comprises means, such as a T bar, integrated with the stabilizer plate.

The present invention also provides a method for removing and installing a shower drain. The method for removing the shower drain comprises the steps of providing a shower drain tool having a blade and a stabilizer plate, positioning the tool on the shower drain with the blade engaging the ribs of the drain and the stabilizer plate preventing the tool from falling through the drain into the drain pipe, and rotating the blade to apply torque to the ribs of the drain to remove the drain. The method for installing the shower drain comprises the steps of providing a shower drain tool having a blade and a stabilizer plate, rotating the flange of the drain onto a drain pipe until finger-tight, temporarily securing the rim of the drain to the flange, positioning the tool on the rim with the blade engaging the ribs of the rim and the stabilizer plate preventing the tool from falling through the drain into the drain pipe, rotating the blade to apply torque to the ribs of the rim to tighten the flange on the drain pipe, removing the rim from the flange, positioning a shower pan membrane atop the flange, and permanently securing the rim to the flange.

Accordingly, the present invention provides a shower drain tool for removal of a commonplace shower drain used in a shower having a tile floor, such as the E-Z Test drain. The shower drain tool also facilitates installation of such a drain. Advantageously, while the shower drain tool in accordance with the present invention provides an effective tool for removal and installation of a shower drain, the shower drain tool has a rugged construction and can be inexpensively produced.

BRIEF DESCRIPTION OF THE DRAWINGS

The above and other features and the concomitant advantages of the shower drain tool in accordance with the present invention will be better understood and appreciated by those persons skilled in the art after a consideration of the accompanying drawings in conjunction with the detailed description of the preferred embodiments that follows. In the drawings.

DETAILED DESCRIPTION OF THE PREFERRED EMBODIMENTS

Various embodiments of the shower drain tool in accordance with the present invention will now be described in connection with the accompanying drawings. One embodiment of the present invention provides a tool to remove a shower drain commonly used as a drain for a shower having a tile floor. The shower drain tool in accordance with the present invention can also facilitate installation of the drain.

Figure 1:
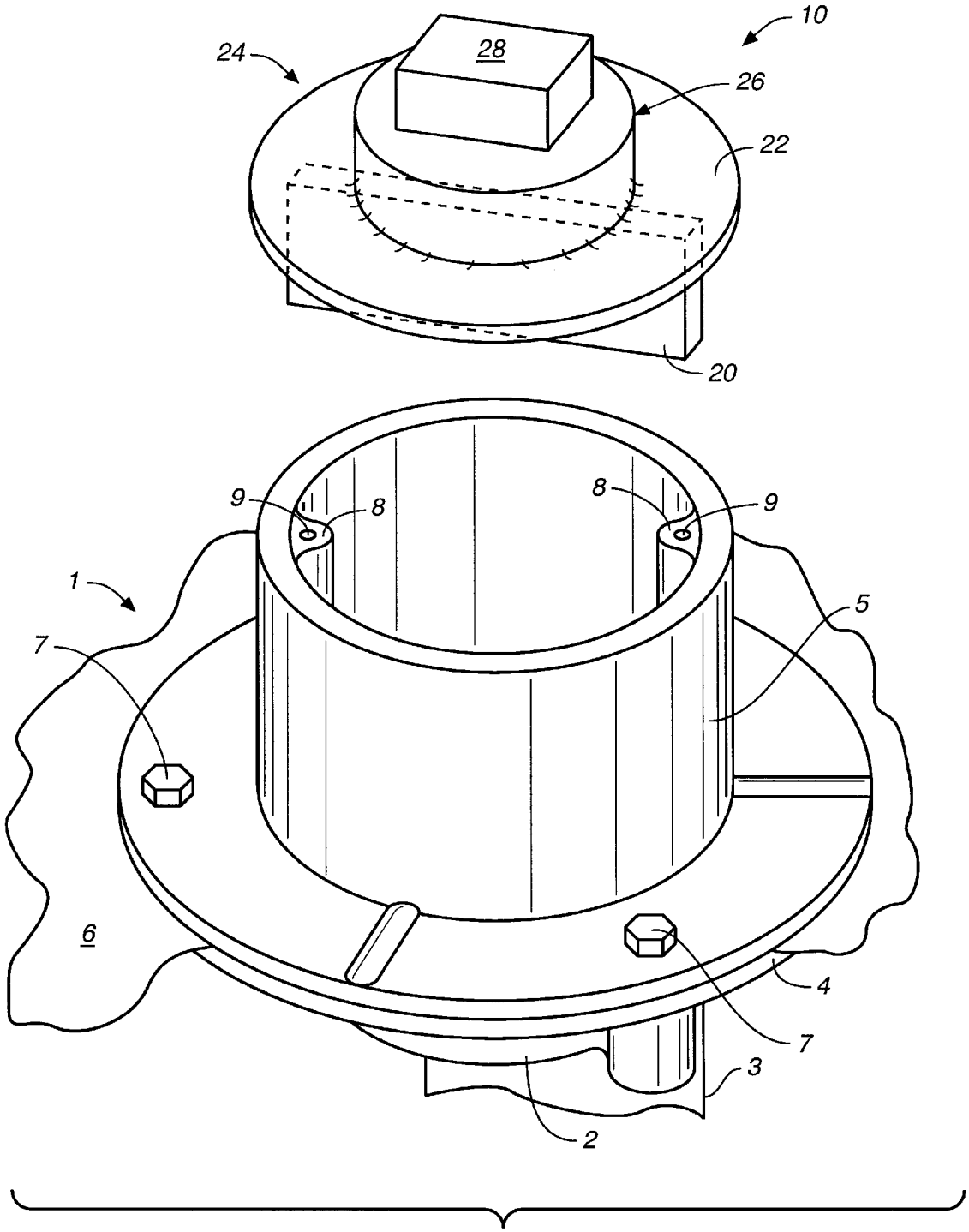
FIG. 1 is a perspective view of a known shower drain and one embodiment of the shower drain tool in accordance with the present invention.

One embodiment of the shower drain tool in accordance with the present invention, generally indicated by the numeral 10, is shown in FIG. 1. The tool 10 comprises a blade 20 for engagement with ribs 8 of a shower drain 1 so that the drain can be rotated by torque applied to the blade. The blade 20 is preferably constructed from a durable material, for example, a one-quarter-inch thick rectangular steel plate. The length of the blade 20 is preferably slightly less than the inside diameter of a rim 5 of the drain 1. The height of the blade 20 is sufficient to frictionally engage the ribs 8 of the drain 1 without scarring the ribs or easily sliding along the length of the ribs when the blade is engaged with the ribs and the blade is rotated. In one implementation, the height of the blade 20 is one inch.

As shown in FIG. 1, the tool 10 also comprises a stabilizer plate 22 connected to the blade 20 to seat the tool on the drain 1 and prevent the tool from falling through the drain into a drain pipe 3. The stabilizer plate 22 is preferably constructed from a durable material, for example, a one-quarter-inch thick circular steel plate. The diameter of the stabilizer plate 22 is greater than the length of the blade 20 and is approximately the outside diameter of the rim 5 of the drain 1. The diameter of the stabilizer plate 22 is sufficient that the stabilizer plate frictionally engages the upper edge of the rim 5 to maintain the tool 10 flush with the opening of the drain 1 when the tool is in operative position with respect to the drain and to maintain the tool seated on the drain while the tool is being rotated. Preferably, the blade 20 is welded to the stabilizer plate 22 to form a rigid connection between the blade and the stabilizer plate.

Additionally, as shown in FIG. 1, the tool 10 preferably comprises means 24 coupled to the stabilizer plate 22 for imparting rotation to the blade 20 of the tool. In the embodiment shown in FIG. 1, the means 24 coupled to the stabilizer plate 22 for imparting rotation to the blade 20 consists of a tool adapter 26 comprising an approximately square nut 28 mounted to the approximate center of the stabilizer plate. The nut 28 is configured to be spanned by a rotation imparting means, such as an adjustable wrench (not shown) or open-end wrench (not shown), and rotated to apply torque via the blade 20 to the drain 1 to remove or install the drain. In one implementation, the nut 28 is a conventional steel pipe plug, and the dimension of the edge of the nut can be in the range of one-half inch as typically provided on a one-and-a-quarter-inch pipe plug to one-and-a-quarter inches as typically provided on a two-inch pipe plug. The height of the nut 28 provided on a conventional pipe plug is typically on the order of one-half inch to provide firm engagement with an adjustable or open-end wrench. In the case in which the nut 28 comprises a pipe plug, the pipe plug can be directly welded to the stabilizer plate 22.

Figure 2:
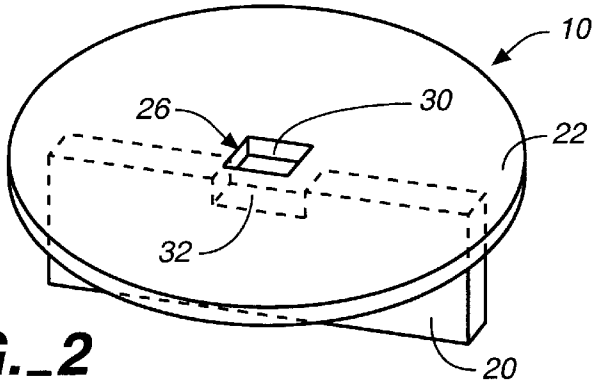
FIG. 2 is a perspective view of another embodiment of the shower drain tool in accordance with the present invention.

In another embodiment shown in FIG. 2, the tool adapter 26 comprises an approximately square hole 30 provided in the approximate center of the stabilizer plate 22, into which a rotation imparting means, such as a socket wrench drive (not shown) or the tip of a breaker bar (not shown) or T bar (not shown), can be inserted to rotate the tool 10. The hole 30 is preferably cut in the approximate center of the stabilizer plate 22 before the blade 20 is mounted to the stabilizer plate. Also, in order to accommodate the length of a socket wrench drive, or the tip of a breaker bar or T bar, a notch 32 is formed in the blade 20 in alignment with the hole 30 in the stabilizer plate 22. The notch 32 is also preferably cut in the blade 20 before the blade and the stabilizer plate 22 are welded together.

Figure 3:
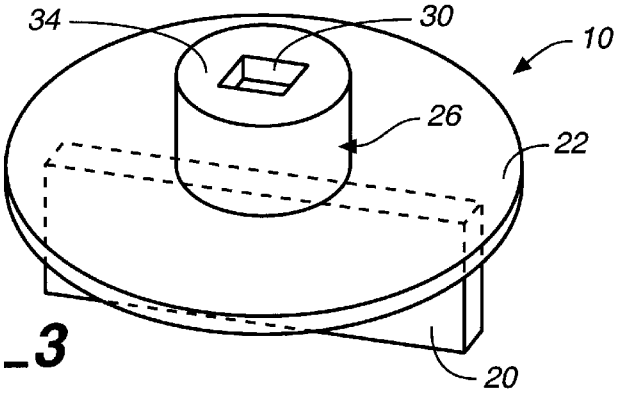
FIG. 3 is a perspective view of an additional embodiment of the shower drain tool in accordance with the present invention.

In yet another embodiment shown in FIG. 3, the tool adapter 26 again comprises an approximately square hole 30 into which a rotation imparting means, such as a socket wrench drive or the tip of a breaker bar or T bar, can be inserted to rotate the tool 10. In contrast to the embodiment shown in FIG. 2, however, the hole 30 resides in a spacer 34 mounted to the approximate center of the stabilizer plate 22. For example, the spacer 34 can be a conventional steel spacer having a square hole. The height of the spacer 34 is sufficient to accommodate the length of a socket wrench drive, or the tip of a breaker bar or T bar. The spacer 34 is welded to the stabilizer plate 22.

Figure 5:
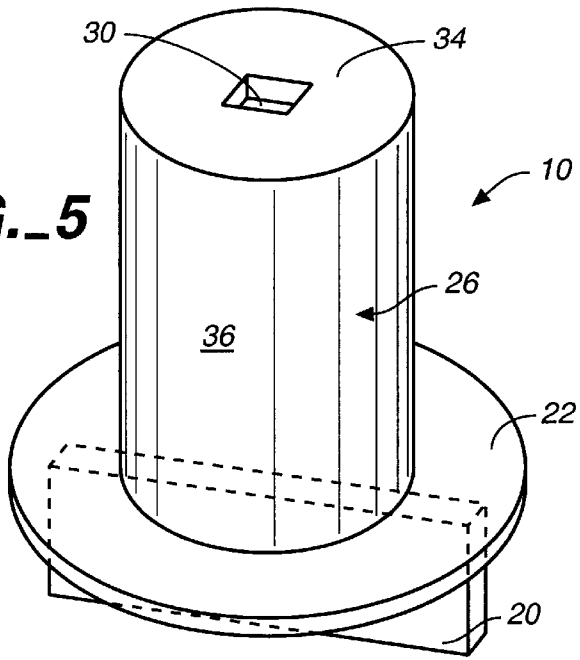
FIG. 5 is a perspective view of a further embodiment of the shower drain tool in accordance with the present invention.
Figure 4:
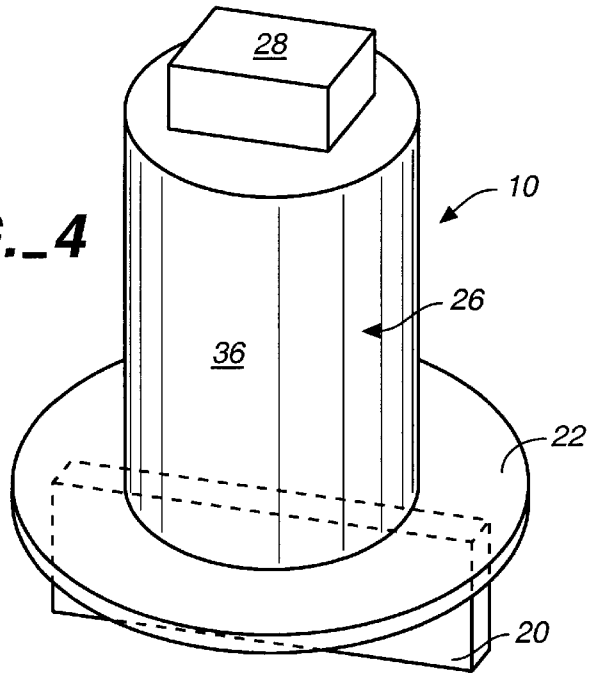
FIG. 4 is a perspective view of yet another embodiment of the shower drain tool in accordance with the present invention.
Figure 6:
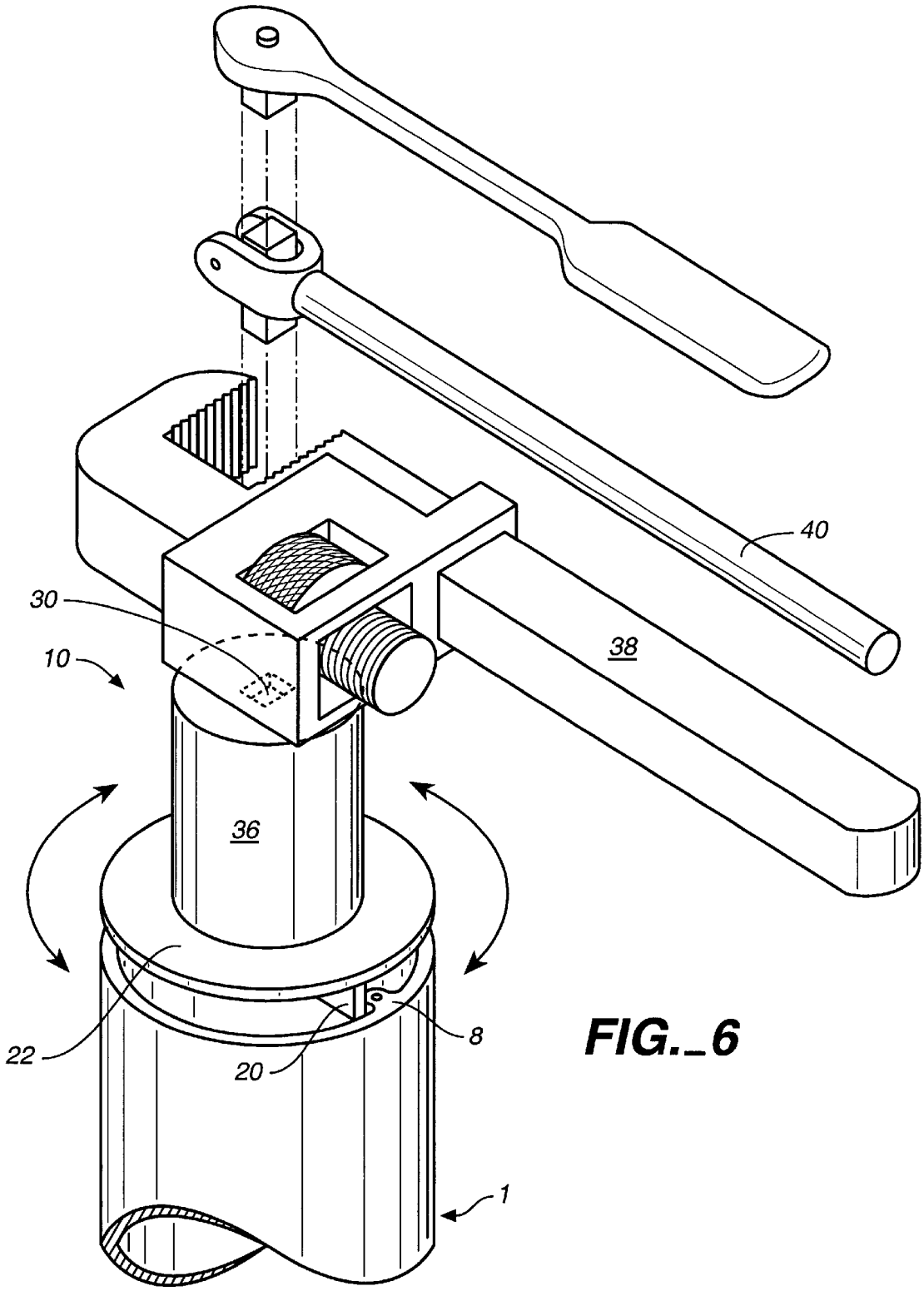
FIG. 6 is a perspective view of the embodiment of the shower drain tool shown in FIG. 5 in operative position.

A further embodiment of the present invention is shown in FIG. 4. The tool adapter 26 comprises a pipe wrench extension 36 mounted to the approximate center of the stabilizer plate 22 so that a pipe wrench (not shown) can be used to rotate the tool 10. In one implementation, the pipe wrench extension 36 is a length of steel pipe welded to the stabilizer plate 22. As shown in FIG. 4, the tool adapter 26 also preferably comprises the nut 28 mounted to the pipe wrench extension 36. The tool adapter 26 shown in FIG. 4 can be constructed by welding a pipe plug in a length of pipe. Alternatively, the tool adapter 26 shown in FIG. 5 preferably comprises the spacer 34 mounted to the pipe wrench extension 36. The tool adapter 26 shown in FIG. 5 can be constructed by welding the spacer 34 within a length of pipe. The height of the pipe wrench extension 36 is sufficient to enable a conventional pipe wrench 38 to grip the circumference of the pipe wrench extension, as indicated in FIG. 6, or to accommodate the tip of a breaker bar 40, as also indicated in FIG. 6. The inclusion of the nut 28 or hole 30 in addition to the pipe wrench extension 36 accommodates two different motion imparting means to rotate the tool 10.

Figure 7:
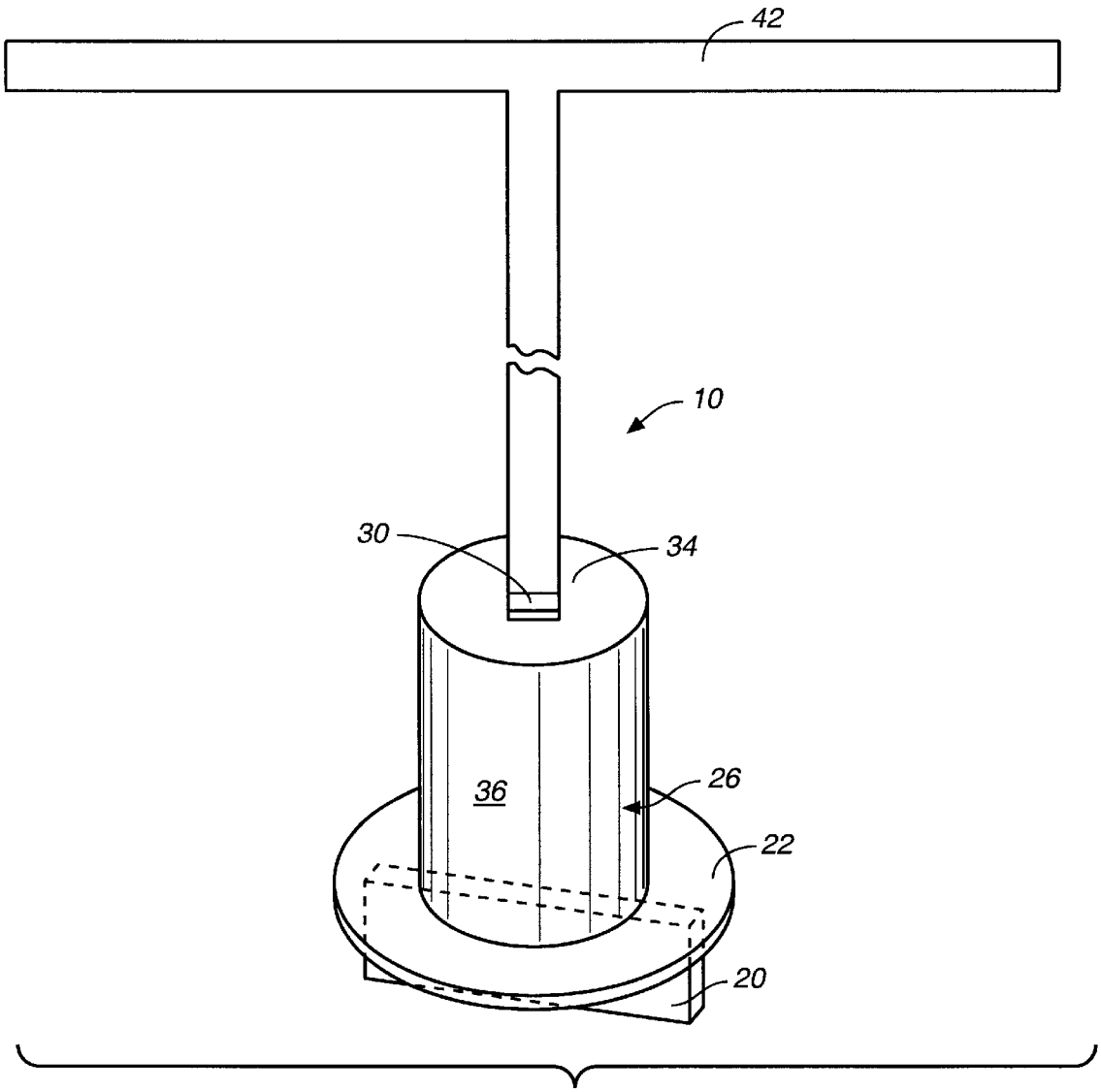
FIG. 7 is a perspective view of a still further embodiment of the shower drain tool in accordance with the present invention.

In a modified embodiment, the means coupled to the stabilizer plate 22 for imparting rotation to the blade 20 comprises means, such as a T bar 42, integrated with the stabilizer plate 22, as shown in FIG. 7. For example, the tip of the T bar 42 can be welded in the hole 30 to construct a tool 10 having an integral rotation imparting means.

The present invention also provides a method for removing and installing a shower drain 1. The method for removing the shower drain 1 comprises the steps of providing the tool 10 having the blade 20 and stabilizer plate 22, positioning the tool on the drain with the blade engaging the ribs 8 of the drain and the stabilizer plate preventing the tool from falling through the drain into the drain pipe 3, and rotating the blade to apply torque to the ribs of the drain to remove the drain. Although the drain 1 may be tightly connected to the drain pipe 3 due to corrosion, a great deal of mechanical force can be applied through the tool 10 to loosen and remove the drain.

The method for installing the shower drain 1 comprises providing the tool 10 having the blade 20 and stabilizer plate 22 and the following additional steps. Initially, the flange 2 of the drain 1 is rotated by hand onto the drain pipe 3 until finger-tight. Then, the rim 5 is temporarily secured to the flange 2 by the bolts 7. Next, the tool 10 is positioned on the rim 5 with the blade 20 engaging the ribs 8 of the rim and the stabilizer plate 22 preventing the tool from falling through the drain 1 into the drain pipe 3, and the blade is rotated to apply torque to the ribs of the rim to tighten the flange 2 on the drain pipe. Thereafter, the tool 10 is stowed. The rim 5 is then removed from the flange 2, the shower pan membrane 6 is placed atop the flange, and the rim is finally permanently bolted to the flange.

Accordingly, the present invention provides a shower drain tool 10 to facilitate removal of a commonplace shower drain 1 used in a shower having a tile floor, such as the E-Z Test drain. The shower drain tool 10 can also be used during installation of such a drain 1. Advantageously, the shower drain tool 10 has a rugged construction and can be produced using inexpensive components welded together.

Unlike the wrench disclosed in U.S. Pat. No. 5,090,276, which includes the depth limiting device (20) which is dimensioned to enter the throat of the tapered strainer base (30), the shower drain tool 10 comprises the stabilizer plate 22, which is dimensioned so that the stabilizer plate does not enter the drain 1 and, instead, remains firmly seated on the drain. Furthermore, unlike the wrench disclosed in U.S. Pat. No. 5,090,276, which requires notches (40) provided in the strainer base (30), the tool 10 does not require any modification of the drain 1.

While various embodiments of a shower drain tool are described above, the principles of the present invention also apply to shower drain tools in which the configuration of the tools is modified. For example, in a modified embodiment of the tool 10, the blade 20, stabilizer plate 22, and means 24 coupled to the stabilizer plate for imparting rotation to the blade can be cast, forged, or machined from a single blank of durable material, such as steel. Although a particular socket wrench configuration is disclosed in FIG. 6, it is to be understood by one skilled in the art that any socket wrench configuration is contemplated to provide rotation imparting means. These and other changes and modifications and applications of the present invention can be made without departing from the scope of the invention as defined by the appended claims.

Having described my invention, what I desire to claim and secure by Letters Patent is:

1. A shower drain tool, comprising:

a shower drain commonly used as a drain for a shower having a tile floor, the shower drain comprising a threaded flange which is rotated onto a threaded drain pipe, the shower drain further comprising a rim, the rim being mounted to the flange with a shower pan membrane captured between the flange and the rim, the rim having an upper edge and internal ribs;

a blade for engagement with the ribs of the shower drain so that the drain can be rotated by torque applied to the blade;

a stabilizer plate connected to the blade to seat the tool on the upper edge of the rim of the shower drain, the diameter of the stabilizer plate being sufficient that the stabilizer plate frictionally engages the upper edge of the rim to maintain the tool seated on the drain while the tool is being rotated and to prevent the tool from falling through the drain into the drain pipe; and means coupled to the stabilizer plate for imparting rotation to the blade.

2. The shower drain tool as defined in claim 1 wherein the means coupled to the stabilizer plate for imparting rotation to the blade comprises a pipe wrench extension connected to the stabilizer plate, the pipe wrench extension being configured so that a pipe wrench can grip the extension and be used to rotate the tool.

3. The shower drain tool as defined in claim 1 wherein the means coupled to the stabilizer plate for imparting rotation to the blade comprises a tool adapter comprising a nut to be rotated to apply torque via the blade to the shower drain.

4. The shower drain tool as defined in claim 3 wherein the nut is configured to be spanned by one of an adjustable wrench or open-end wrench and rotated to apply torque via the blade to the shower drain.

5. The shower drain tool as defined in claim 4 wherein the tool adapter further comprises a pipe wrench extension between the stabilizer plate and the nut, the pipe wrench extension being configured so that a pipe wrench can grip the extension and be used to rotate the tool.

6. The shower drain tool as defined in claim 3 wherein the tool adapter further comprises a pipe wrench extension between the stabilizer plate and the nut, the pipe wrench extension being configured so that a pipe wrench can grip the extension and be used to rotate the tool.

7. The shower drain tool as defined in claim 1 wherein the means coupled to the stabilizer plate for imparting rotation to the blade comprises a tool adapter comprising an approximately square hole to be rotated to apply torque via the blade to the shower drain.

8. The shower drain tool as defined in claim 7 wherein the hole is configured for insertion of one of a socket wrench drive, a tip of a breaker bar, and a tip of a T bar and rotated to apply torque via the blade to the shower drain.

9. The shower drain tool as defined in claim 8 wherein the tool adapter further comprises a pipe wrench extension between the stabilizer plate and the hole, the pipe wrench extension being configured so that a pipe wrench can grip the extension and be used to rotate the tool.

10. The shower drain tool as defined in claim 7 wherein the tool adapter further comprises a pipe wrench extension between the stabilizer plate and the hole, the pipe wrench extension being configured so that a pipe wrench can grip the extension and be used to rotate the tool.

11. The shower drain tool as defined in claim 1 wherein the means coupled to the stabilizer plate for imparting rotation to the blade of the shower drain tool comprises an approximately square hole provided in the stabilizer plate to be rotated to apply torque via the blade to the shower drain.

12. The shower drain tool as defined in claim 11 wherein the hole extends through the stabilizer plate and the blade is provided with a notch to accommodate a rotation imparting means disposed in the hole.

13. The shower drain tool as defined in claim 12 wherein the rotation imparting means is selected from among the group consisting of a socket wrench drive, a tip of a breaker bar, and a tip of a T bar rotated to apply torque via the blade to the shower drain.

14. The shower drain tool as defined in claim 1 wherein the means coupled to the stabilizer plate for imparting rotation to the blade comprises a rotation imparting means integral with the stabilizer plate.

15. The shower drain tool as defined in claim 1 wherein the rotation imparting means is selected from among the group consisting of a socket wrench drive, a breaker bar, and a T bar rotated to apply torque via the blade to the shower drain.

16. A method for removing a shower drain commonly used as a drain for a shower having a tile floor, the shower drain comprising a threaded flange which is rotated onto a threaded drain pipe, the shower drain further comprising a rim, the rim being mounted to the flange with a shower pan membrane captured between the flange and the rim, the rim having an upper edge and internal ribs, the method comprising the steps of:

providing a shower drain tool having a blade and a stabilizer plate;

positioning the tool on the shower drain with the blade engaging the ribs of the drain and the stabilizer plate engaging the upper edge of the drain, the diameter of the stabilizer plate being sufficient that the stabilizer plate frictionally engages the upper edge of the drain for maintaining the tool seated on the drain while the tool is being rotated and preventing the tool from falling through the drain into the drain pipe; and rotating the blade to apply torque to the ribs of the drain to remove the drain.

17. A method for installing a shower drain commonly used as a drain for a shower having a tile floor, the shower drain comprising a threaded flange which is rotated onto a threaded drain pipe, the shower drain further comprising a rim, the rim being mounted to the flange with a shower pan membrane captured between the flange and the rim, the rim having internal ribs, the method comprising the steps of:

providing a shower drain tool having a blade and a stabilizer plate;

rotating the flange of the drain onto a drain pipe until finger-tight;

temporarily securing the rim of the drain to the flange;

positioning the tool on the rim with the blade engaging the ribs of the rim and the stabilizer plate preventing the tool from falling through the drain into the drain pipe;

rotating the blade to apply torque to the ribs of the rim to tighten the flange on the drain pipe;

removing the rim from the flange;

positioning the shower pan membrane atop the flange; and permanently securing the rim to the flange.

* * * * *